United States Patent [19]

Iizuka et al.

[11] Patent Number: 4,899,277

[45] Date of Patent: Feb. 6, 1990

[54] BORE HOLE SCANNER WITH POSITION DETECTING DEVICE AND LIGHT POLARIZERS

[75] Inventors: Yunosuke Iizuka; Takashi Ishii; Yoshihiro Mukawa; Kouji Nagata, all of Tokyo; Yoshitaka Matsumoto, Yokohama; Osamu Murakami, Funabashi, all of Japan

[73] Assignees: Shimizu Construction Co., Ltd.; Core Inc., both of Tokyo, Japan

[21] Appl. No.: 263,950

[22] Filed: Oct. 28, 1988

[30] Foreign Application Priority Data

Oct. 30, 1987 [JP] Japan ..... 62-275545

[51] Int. Cl.[4] ..... G02B 23/26

[52] U.S. Cl. ..... 364/422; 356/241

[58] Field of Search ..... 356/241; 364/422; 250/578, 225, 226

[56] References Cited

U.S. PATENT DOCUMENTS 4,305,661 12/1981 Pryor et al. ..... 356/241

4,317,632 3/1982 Orphan et al. ..... 356/241

4,779,201 10/1988 Iizuka et al. ..... 364/422

*Primary Examiner*—Jerry Smith

*Assistant Examiner*—David Huntley

*Attorney, Agent, or Firm*—Armstrong, Nikaido, Marmelstein, Kubovcik & Murray

[57] ABSTRACT

A bore hole scanner includes a light projecting device for projecting a light beam toward a bore hole wall surface. A conical mirror is arranged coaxially with respect to a sonde for condensing light reflected from the bore hole wall surface. An image forming device is arranged in front of the conical mirror. A photoelectric transducing device converts a light signal into an electric signal. Optical fibers introduce an image, which is formed on concentric circles by the image forming device to the photoelectric transducing device. A data processing device scans and extracts signals from the photoelectric transducing device and generates and processes image data indicative of the bore hole wall surface. A sonde position detecting device detects the orientation and position of the sonde. Rotating portions are dispensed with by using the conical mirror and optical fibers, and a linear CCD array can be used as the photoelectric transducing device.

2 Claims, 6 Drawing Sheets

BORE HOLE SCANNER WITH POSITION DETECTING DEVICE AND LIGHT POLARIZERS

BACKGROUND OF THE INVENTION

This invention relates to a bore hole scanner (an apparatus for observing the wall of a bore hole which, in the present invention, refers to boring holes and pipe holes and the like) for being raised, lowered and moved within a bore hole to observe the wall of the bore hole by means of a scanner incorporated in a sonde.

In drilling underground cavities for dams, tunnels and the like, a geological survey is performed at the site and the results of the survey are reflected in the design drawings. It is also necessary to select the method of executing the project and to assure perfection in terms of how the project proceeds, project safety measures and the like. In a geological survey of this kind, it is generally necessary to ascertain the cracking direction, inclination and properties of the rock, as well as the direction and dip of the bed. One method of performing such a survey is to bore a hole at the site and sample the core in order to observe its nature. Another method is to bore a hole at the site and make a direct observation of the bore hole wall. In order to execute the method that entails direct observation of the bore hole wall, various items of equipment are available such as televisions, periscopes, cameras and scanners, all for observation of the bore hole wall.

With reference to FIG. 1, there is shown an apparatus 30 for reading in a signal produced by image pick-up means provided in a sonde 32, and for generating observation information indicative of the bore hole by subjecting the signal to data processing. The apparatus 30 includes a CRT for monitoring the image of the bore hole wall, a data processor, namely a computer, a memory device such as a magnetic tape, floppy disc or magnetic disc, and an output unit such as a printer. As shown in FIG. 1(*b*), the sonde 32 houses the image pick-up means which produces the image of the bore hole wall. A winch 31 [FIG. 1(*a*)]raises and lowers the sonde 32.

With reference again to FIG. 1(*b*), the sonde 32 raised and lowered in the bore includes an optical head 37 coupled to a swiveling motor 33 and having a direction finder 34, a lens 35 and a mirror 36. Also provided are a light source 43 for transmitting a light beam toward the optical head 37 through a half-mirror 40, a slit 41 and a lens 42 for forming the light beam, and a slit 38 and photoelectric transducer 39 for sensing the light beam from the optical head 37 after the beam has been reflected at the bore wall surface. With an arrangement of this type, the light from the light source 43 is shaped into a beam by the slit 41 and lens 42, and the resulting light beam is projected toward the bore hole wall via the half-mirror 40, mirror 36 and lens 35. The intensity of the light beam reflected from the bore wall surface is measured by the photoelectric transducer 39 via the lens 35, mirror 36, half-mirror 40 and slit 38. While the optical head 37 is being swiveled by the swiveling motor 33, the sonde 32 is lowered within the bore hole. When this done, a bore hole wall scan of the kind shown in FIG. 2 is carried out and an electric signal corresponding to the intensity of the reflected beam is obtained from the photoelectric transducer 39.

An arrangement can be adopted in which a triangular mirror is rotated instead of the half-mirror 40, in which case the light from the light source would be reflected by one side of the triangular mirror to irradiate the bore hole wall surface, with the reflected light being introduced to the photoelectric transducer upon being reflected by another side of the triangular mirror. Such an arrangement, as disclosed, for example, in the specification of U.S. Pat. No. 4,779,201, has been put into practical use by the present inventors.

However, since the observation of the bore hole wall by the conventional bore hole scanner employs a mechanical scanning system, as described above, problems are encountered in the mechanical scanning section that involves rotational movement. Specifically, the swiveling motor 33, the direction finder 34 and the optical head 37 having the lens 35 mirror 36, all of which constitute the mechanical scanning section, sustain severe wear due to the rotational motion thereof. The maintenance required, such as replacement and adjustment, involves considerable labor and expense.

SUMMARY OF THE INVENTION

An object of the present invention is to provide a bore hole scanner in which movable portions in the bore hole observing section are eliminated to do away with wearing components and facilitate maintenance.

Another object of the present invention is to provide a bore hole scanner with which a bore hole can be scanned at high speed.

In accordance with the present invention, the foregoing objects are attained by providing a bore hole scanner comprising a light projecting device for projecting a light beam toward the bore hole wall, a conical mirror arranged coaxially with respect to a sonde for condensing light reflected from the bore hole wall, image forming device arranged in front of the conical mirror, photoelectric transducing device for converting a light signal into an electric signal, optical fibers for introducing an image, which is formed on concentric circles by the image forming device, to the photoelectric transducing device, data processing device for scanning and extracting signals from the photoelectric transducing device, and for generating and processing image data indicative of the hole wall surface, and sonde position detecting device for detecting orientation and position of the sonde.

In accordance with the invention constructed as described above, the signals from the photoelectric transducing device are scanned, and image data relating to the bore hole wall surface is generated and processed, by the data processing device while the sonde is raised and lowered, thereby providing a continuous image of the wall surface. Moreover, observation of the wall surface based on accurate position information is made possible by correlating the image data and sonde position by the sonde position detecting device.

Still other objects and advantages of the invention will in part be obvious and will in part be apparent from the specification.

The invention accordingly comprises the features of construction, combinations of elements and arrangement of parts which will be exemplified in the construction hereinafter set forth, and the scope of the invention will be indicated in the claims.

DESCRIPTION OF THE PREFERRED EMBODIMENTS

Embodiments of the invention will now be described with reference to the drawings.

Figure 1A:
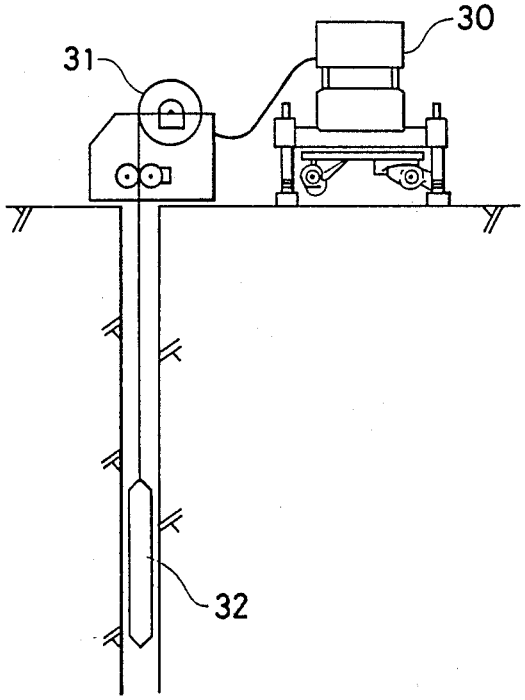
FIG. 1(a) PRIOR ART
FIGS. 1(*a*) and 1(*b*) are views showing a specific example of the arrangement of a bore hole scanner used in the prior art.
Figure 1B:
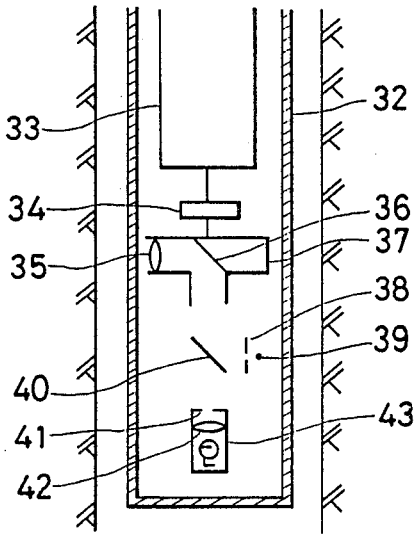
FIG. 1(b) PRIOR ART
Figure 2A:
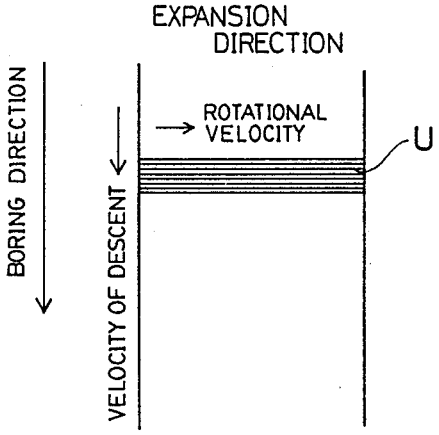
FIG. 2(a) PRIOR ART
FIGS. 2(*a*), and 2(*b*) are views illustrating paths on the developed surface of a hole wall scanned by a light beam.
Figure 2B:
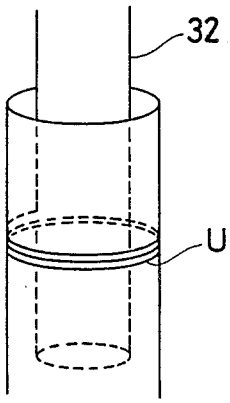
FIG. 2(b) PRIOR ART
Figure 3:
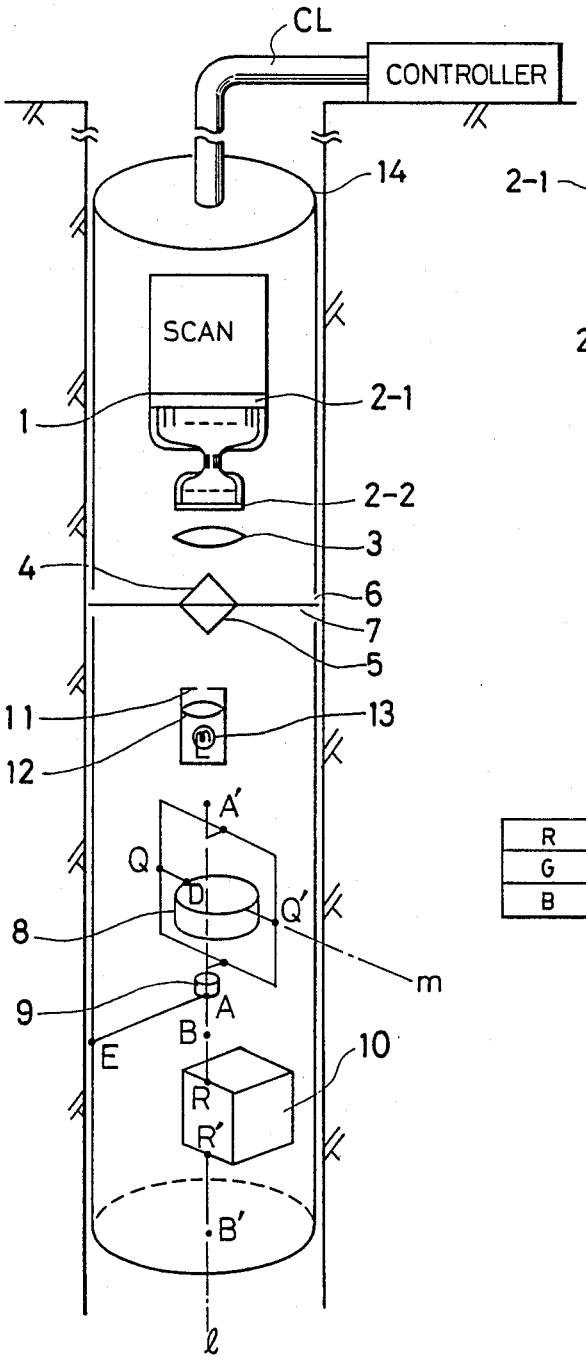
FIG. 3 is a view showing a first embodiment of a bore hole scanner according to the present invention.

In FIG. 3, a sonde, which is indicated at numeral 14, houses an image pick-up device in its upper part and a bore hole curvature measuring device in its lower part. The image pick-up device is adapted to irradiate the wall of a bore hole with light from a light source 13 and provide a scanning section 1 with image data resulting from the light reflected from the hole wall. A light-shielding plate 7 has conical mirrors 4 and 5 attached to its upper and lower sides, respectively, and divides a slit 6 in half in the vertical direction. The slit 6 is covered with a transparent member such as a glass sheet. The bore hole wall is irradiated with light from the lower side of the slit 6 thus divided by the light-shielded plate 7, and light reflected from the bore hole wall is introduced from the upper side of the slit. Accordingly, the conical mirror 5 provided on the lower side of the light-shielding plate 7 is for the purpose of projecting light, and the conical mirror 4 provided on the upper side is for condensing the light reflected from the bore hole wall surface. A photoelectric transducer 2-1 comprises a linear array of a number of photoelectric transducer elements. The reference position of the transducer is made to coincide with a reference position E of the sonde 14. Optical fibers 2-2 each have one end arrayed on the circumference of a circle and the other end connected to a respective one of the photoelectric transducer elements of the photoelectric transducer 2-1. A lens 3 forms the light from the conical mirror 4 on the one ends of the optical fibers 2-2. The scanning section 1 scans the photoelectric transducer 2-1 and reads in the image data relating to the wall of the bore hole.

The operation of the image pick-up device will now be described.

When the light beam is projected from the light source 13 through the lens 12 and slit 11, the light beam is reflected by the conical mirror 5 to irradiate the bore hole wall from the lower side of the slit 6. The light reflected at the hole wall is introduced from the upper side of the slit 6, reflected by the conical mirror 4, condensed by the lens 3 and formed on one end of the optical fibers 2-2 through the lens 3. The resulting optical signals are guided to the photoelectric transducer 2-1, where the signals are converted into electric signals successively scanned by the scanning section 1 to read in observation data relating to the bore hole wall. When the sonde 14 is raised and lowered while this operation is being repeated, a continuous image of the bore hole wall is obtained.

Figure 4A:
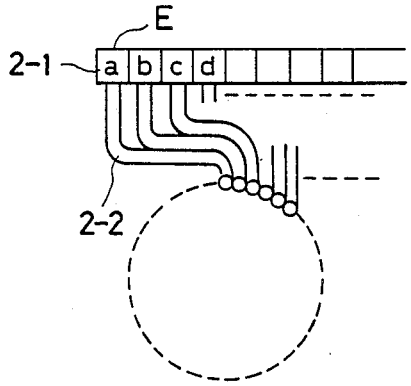
FIGS. 4(*a*)–4(*c*) are views showing an example construction of a photoelectric transducing section.
Figure 4B:
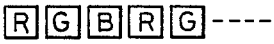
Figure 4C:
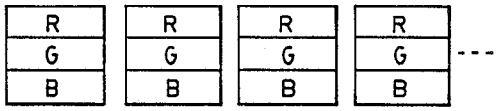

The arrangement constituted by the optical fibers 2-2 and photoelectric transducer 2-1 is such that one end of the optical fibers 2-2 is arrayed in a donut-shaped configuration and the other ends of the optical fibers are connected to the photoelectric transducer 2-1 comprising the number of photoelectric transducer elements, as shown in FIG. 4(*a*). A linear CCD (charge coupled device) array available on the market can be used as the photoelectric transducer 2-1. The photoelectric transducer elements are arrayed as shown by a, b, c, d, e, . . . in FIG. 4(*a*), and signals from these elements are scanned by being read in order by the scanning section 1. In a case where the image data are read in as color data, polarizers for the three primary colors R (red), G (green) and B (blue) of light are provided, and these are disposed in a repeating array for elements a, b, c, d, etc., as shown in FIG. 4(*b*), or R, G and B lines of these polarizers for each element a, b, c, d, etc. are disposed in concentric circles a portion of which is shown in FIG. 4(*c*). A shift register, by way of example, can be used as a circuit for reading out data from this photoelectric transducer. It should be noted that since the read-out circuitry does not constitute the gist of the invention, the CCD sensor array read-out circuit used in the image reading means need not be used.

Figure 5:
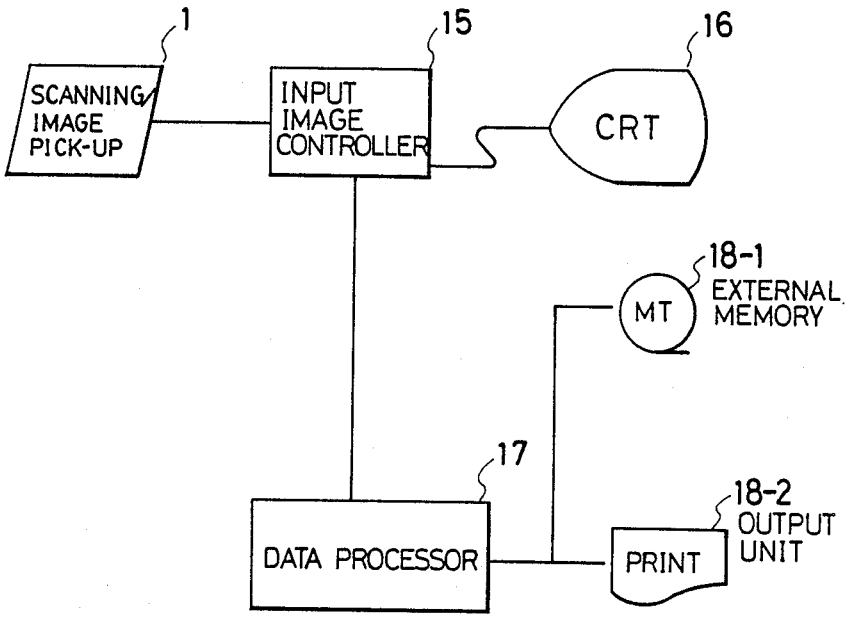
FIG. 5 is a block diagram showing an example of the construction of an image processing system.

With reference to FIG. 5, there is shown an input image controller 15 for controlling the scanning section 1 and a monitor CRT 16 to introduce the image data from the scanning section 1 to a data processor 17 and to display the data on the CRT 16. The data processor 17, which comprises a personal computer, a special-purpose processor or the like, receives an input of image data from the scanning section 1 via the input image controller 15 and then proceeds to process the data. An external memory unit 18-1 stores the image data and comprises a magnetic tape, a floppy disc, a magnetic disc or the like. An output unit 18-2 prints out the image data and comprises a printer, a plotter or a hard copier. It is permissible to adopt an arrangement in which fissure information and image position information is transmitted to a large-scale computer using a special-purpose line or telephone line.

The sonde 14 of the invention shown in FIG. 3 accommodates a bore hole curvature measuring device in addition to the image pick-up arrangement described above. The bore hole curvature measuring device includes an azimuth finder 8 and dipmeter 10 as a means for measuring curvature, and with a rotation meter 9 as a means for measuring the orientation of the scanner head. The azimuth finder 8 is attached to the sonde 14 at first fulcrums A, A'. The azimuth finder 8 can be freely rotated at these first fulcrums A, A' about an axis l, which coincides with the axial direction of the sonde 14, and at second fulcrums Q, Q' about an axis m, which lies perpendicular to the axis l. The axes l, m are indicated by the broken lines in FIG. 3. This arrangement allows the scanning section to be supported in a state that does not change with respect to the vertical direction from aboveground. The azimuth finder has an internal magnet for measuring the downdip angle of the sonde 14. The dipmeter 10 likewise has fulcrums R, R' at which the dipmeter can be freely rotated about the axis l, and is attached to the sonde 14 at fulcrums B, B'. Thus the arrangement is such that the scanning section can be rotated about the axis l to correspond to the inclination of the sonde 14. The azimuth finder has an internal weight for measuring the dip of the sonde 14. The rotation meter 9 is provided at the position of the fulcrum A, where the azimuth finder 8 is attached, and measures a reference direction E of the sonde 14.

Figure 6:
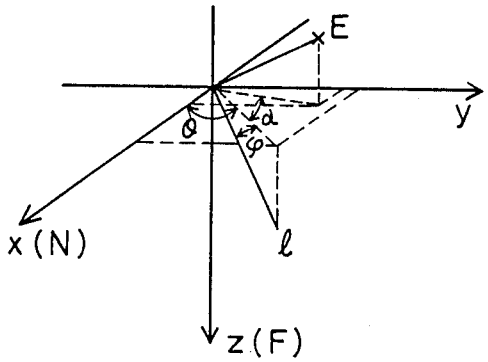
FIG. 6 is a view for describing angles sensed by an azimuth finder and dipmeter.

FIG. 6 illustrates a three-dimensional coordinate system having x, y and z axes. Let the x axis be aligned in the north-south direction, the y axis in the east-west direction and the z axis in the direction of the earth's gravitational force. In such a case an azimuth angle $\theta$ represents an azimuth from north, and an inclination angle $\phi$ represents an inclination from a horizontal plane. With the sonde shown in FIG. 3, the azimuth angle $\theta$ illustrated in FIG. 6 is obtained from the downdip angle indicated by the azimuth finder 8, and the dip $\phi$ depicted in FIG. 6 is obtained from the dip indicated by the dipmeter 10.

More specifically, bore hole curvature is measured by the azimuth finder 8 and dipmeter 10, and the orientation of the sonde is measured by the rotation meter 9. When an observation is make by the image pick-up device, the direction in which an observation is being made can be ascertained in terms of the relative positions between the photoelectric transducer elements and the reference position E set within the sonde. The rotation meter 9 is for measuring the orientation of the sonde reference position E in order to obtain the orientation of the photoelectric transducer, which depends upon the twisting of the rotation meter. More specifically, the orientation of the reference position E of sonde 14 can be obtained by adding the angle of rotation $\delta$ measure by the rotation meter 9 to the azimuth angle $\theta$ measured by the azimuth finder 8.

Figure 7:
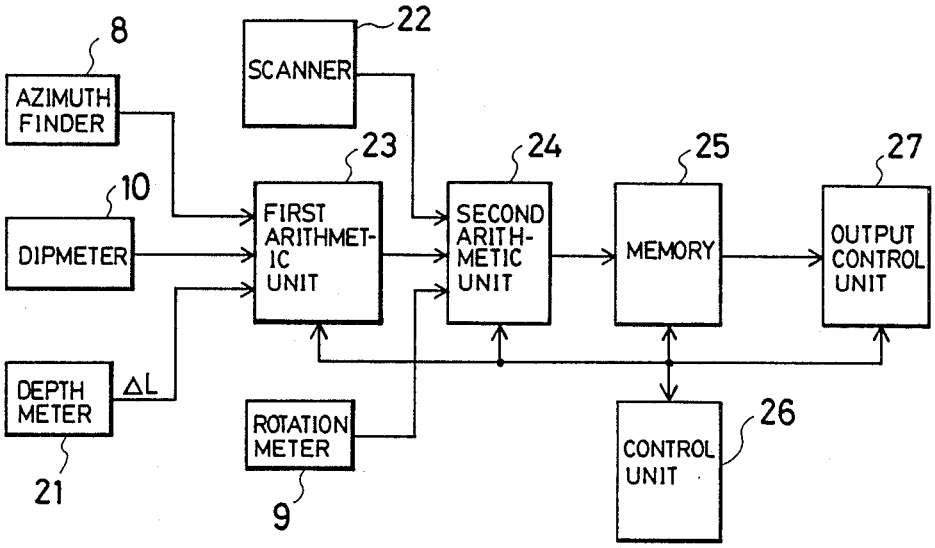
FIG. 7 is a block diagram showing an example of the construction of a bore hole curvature measuring device.

In FIG. 7, a depth gauge 21 is provided on an aboveground controller for controlling the length of a cable CL paid out and is adapted to sense the paid-out length of the cable CL. The azimuth finder 8, dipmeter 10 and depth gauge 21 are connected to a first arithmetic unit 23. When the paid-out length of the cable CL attains a unit length, the first arithmetic unit 23 reads in the azimuth angle $\theta$ and inclination angle $\phi$ from the azimuth finder 82 and dipmeter 21, respectively, and proceeds to calculate the paid-out length of the cable CL in terms of components $\Delta x$, $\Delta y$, $\Delta z$ corresponding to the coordinate space shown in FIG. 6. The calculation is based on the paid-out length $\Delta L$ of the cable CL, the azimuth angle $\theta$ and dip $\phi$.

The output of the first arithmetic unit 23 is applied to a second arithmetic unit 24, which reads sonde position coordinates $X_i$, $Y_i$, $Z_i$ out of a memory 25, these coordinates having been obtained by preceding integration of $\Delta x$, $\Delta y$, $\Delta z$. To these coordinate values the second arithmetic unit 57 adds paid-out lengths $\Delta x$, $\Delta y$, $\Delta z$ calculated by the arithmetic unit 23 to calculate the present position coordinates $X_{i+1}$, $Y_{i+1}$, $Z_{i+1}$ of the sonde. The second arithmetic unit 24 further calculates the observed position based on the scanning data, the sonde rotational angle, and the sonde position obtained by the above-described calculations.

Figure 8:
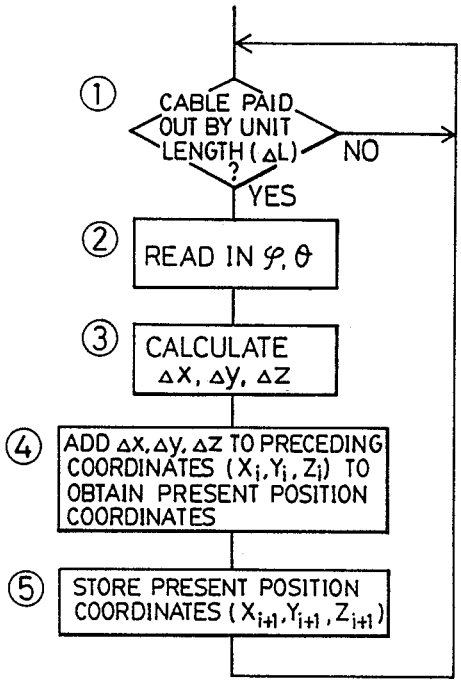
FIG. 8 is a flowchart for describing the flow of processing executed by the bore hole curvature measuring device.
Figure 9A:
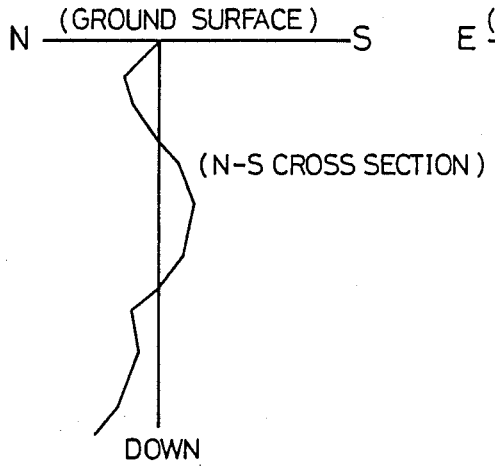
FIGS. 9 (*a*) through 9(*d*) are views illustrating examples of path images obtained by the bore hole curvature measuring device.
Figure 9B:
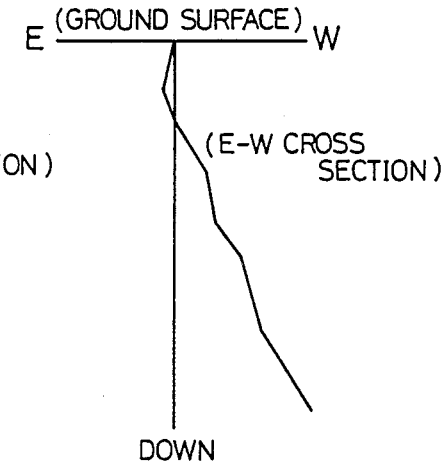
Figure 9C:
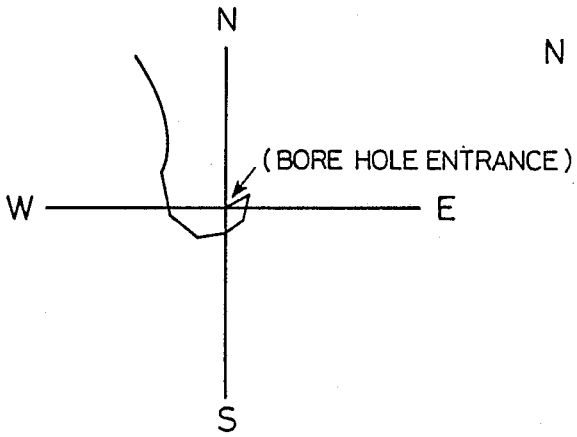
Figure 9D:
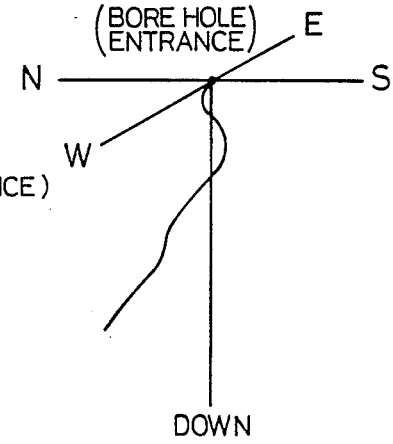

The memory 25 stores the sonde position coordinates X, Y, Z, calculated by the second arithmetic unit 24, in a time-series fashion and also stores the corresponding sonde orientations, scanning data and observation positions. FIG. 8 shows a flowchart of processing up to the step at which the sonde position coordinates X, Y, Z are stored in memory 25. The system of FIG. 7 further includes an output control unit 27 and a controller 26 for executing overall control, inclusive of the arithmetic units 23, 24, memory 25 and output control unit 27. Base on the position coordinates X, Y, Z stored in memory 25, the output control unit 27 delivers data to an output unit (not shown) such as a CRT display or XY plotter to describe the trajectory of the sonde on the display screen or plotter, and also outputs scanning data to obtain a hard copy. An apparatus for producing the hard copy of the scanning data has been proposed separately by the inventors (see the U.S. Pat. No. 4,779,201). The gist of this proposed arrangement is to luminance-modulate the scanning data and obtain a print of the results on film, by way of example. In this case, a horizontal image is not obtained when the scanning data indicative of a curving bore hole is used directly to produce an image. Accordingly, when the individual items of scanning data are stored, the coordinates (observed position) of each photoelectric transducer element are calculated based on the position and dip angle of the sonde, and these coordinates are stored upon being correlated with the scanning data. Scanning data of coordinates having the same depth is read out in regular order and printed on film, thereby providing a hard copy modified into a horizontal image. It is possible to display the observed position (coordinates, etc.) on a corresponding portion of the image. It is also possible to decide the starting point of the hard copy at will by suitably selecting the abovementioned coordinates.

FIG. 9(*a*) illustrates an example of a sonde trajectory in a north-south cross-section. FIG. 9(*b*) illustrates an example of a sonde trajectory in an east-west cross-section. FIG. 9(*c*) shows an example of a sonde trajectory in a plane viewed from above. FIG. 9 (*d*) shows an example of a sonde trajectory in three dimensions. As mentioned above, the controller 26 exercises overall control, which includes control of the arithmetic units 23, 24, memory 25 and output control unit 27.

At larger boring lengths, there are occasions where a bore hole is drilled while the hole develops an irregular curve. This can be caused by crushed rock fragments becoming lodged in the vicinity of the drill bit, by differences in drilling resistance when drilling obliquely through bed interfaces having different hardnesses, or by deviations in the deformation characteristic of the boring rod material. In such cases, a problem arises wherein the geological information obtained by boring represents neither the correct coordinates nor the correct direction. However, this problem can be solved by installing the abovementioned hole curvature measuring device inside the sonde.

Figure 10A:
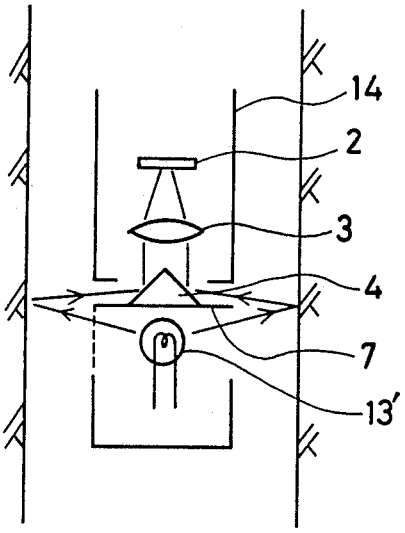
FIGS. 10(*a*), and 10(*b*) are views showing examples of arrangements for irradiating a bore hole wall surface with light.
Figure 10B:
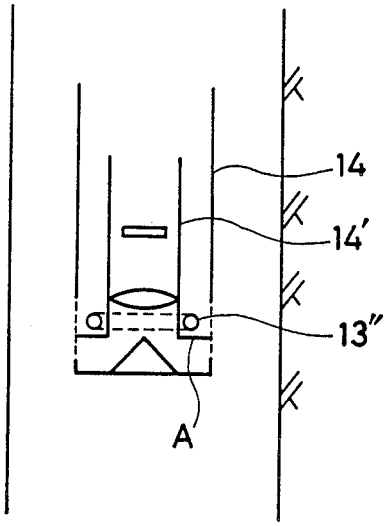

In the example shown in FIG. 10(*a*), the conical mirror disposed on the lower side of the light-shielding plate 7 of FIG. 3 is deleted, a light source 13' is arranged on the lower side of the light-shielding plate 7, and the arrangement is such that the light from the light source 13' irradiates the bore hole wall directly from the lower side of the slit 6. In the example shown in FIG. 10(*b*), an inner cylinder 14' is provided in the sonde 14, a lens and a photoelectric transducer are disposed within the inner cylinder 14', the conical mirror 4 is placed below the cylinder 14', and a light-shielding portion A is provided at the lower end of the inner cylinder 14' as shown. In addition, a ring-shaped light source 13'' is provided on the outer side of the inner cylinder 14'. With this arrangement, light from the light source 13'' irradiates the bore hole wall from the upper side of the slit, and the light reflected from the bore hole wall is introduced from the lower side of the slit. This light is introduced to the lens upon being reflected by the conical mirror 4.

Figure 11:
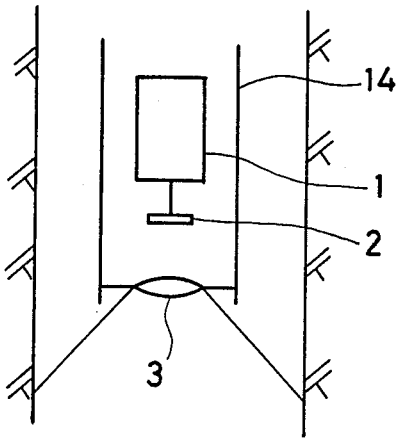
FIG. 11 is a view showing another embodiment of a bore hole scanner according to the present invention.

In another embodiment of the invention shown in FIG. 11, both of the conical mirrors of FIG. 3 are deleted and the bore hole wall is imaged directly through the condensing lens 3.

It should be noted that the present invention is not limited to the foregoing embodiments and can be modified in various ways. For example, though separate conical mirrors are used in the embodiments described, it goes without saying that the conical mirrors 4 and 5 in the arrangement of FIG. 3 can be a unitary body.

Further, the bore hole scanner of the invention can be applied not only to observation of a bore hole wall surface but also to examination of corrosion in underground pipelines and to various other hole wall inspections.

Since the conventional image pick-up section employs a mechanical scanning system in which a mirror is rotated by a motor, a great deal of labor is required for maintenance such as replacement and adjustments demanded by gear wear and a decline in motor performance. In accordance with the present invention, however, the image pick-up apparatus is stationary and has no moving parts whatsoever. By thus eliminating parts that sustain a high degree of wear, labor and expense required for maintenance can be greatly reduced. Since a motor is not employed, noise is reduced and the stability and quality of the image can be improved. Furthermore, since the image pick-up apparatus is stationary and one revolution of wall surface image data can be introduced at the data scanning speed, it is possible for the wall surface image data to be introduced at a high speed so that observation time can be shortened. Since the construction of the image forming section is such that one ends of the optical fibers are arrayed on the circumference of a circle and the other ends lead to a linear array of photoelectric transducers, it is unnecessary to provide phototransducing means specially shaped to conform to the construction of the image forming section. This makes it possible to use a phototransducer array readily available on the market As many apparently widely different embodiments of the present invention can be made without departing from the spirit and scope thereof, it is to be understood that the invention is not limited to the specific embodiments thereof except as defined in the appended claims.

What we claim is:

1. A bore hole scanner for observing a bore hole wall by continuously imaging the bore hole wall by an image pick-up means accommodated in a sonde which is raised and lowered in the bore hole, said bore hole scanner comprising:

light projecting means for projecting a light beam toward the bore hole wall;

a conical mirror, arranged coaxially with respect to said sonde, for condensing light reflected from the bore hole wall;

image forming means arranged in front of said conical mirror;

photoelectric transducing means for converting a light signal into an electric signal, said photoelectric transducer means comprises sets, each set having respective polarizing functions corresponding to three primary colors of light;

optical fibers for introducing an image, by said image forming means, to said photoelectric transducing means, said optical fibers formed in concentric circles;

data processing means for scanning and extracting signals from said photoelectric transducing means, and for generating and processing image data indicative of the bore hole wall surface; and sonde position detecting means for detecting orientation and position of the sonde.

2. The bore hole scanner according to claim 1, wherein said optical fibers have respective first ends arrayed on the concentric circles and respective second ends connected to respective ones of photoelectric transducer elements arranged in a linear array.

* * * * *